US005372302A

United States Patent [19]

Loch et al.

[11] Patent Number: 5,372,302

[45] Date of Patent: Dec. 13, 1994

[54] ECCENTRIC Z-FOLD WITH BUILT-IN RETURN ENVELOPE

[75] Inventors: Mark D. Loch, Whitehall; Dean N. Sauerwine, Emmaus, both of Pa.

[73] Assignee: Moore Business Forms, Inc., Grand Island, N.Y.

[21] Appl. No.: 53,481

[22] Filed: Apr. 28, 1993

[51] Int. Cl.[5] ..... B65D 27/06

[52] U.S. Cl. ..... 229/305; 229/92.1

[58] Field of Search ..... 229/303, 304, 305, 92.1, 229/92.3

[56] References Cited

U.S. PATENT DOCUMENTS

| | | | |
|---|---|---|---|
| 1,089,486 | 3/1914 | Levine . | |
| 2,759,658 | 8/1956 | Sawdon | 229/73 |
| 3,228,586 | 1/1966 | Hayes, Jr. | 229/73 |
| 3,428,237 | 2/1969 | Dowen | 229/305 |
| 3,652,007 | 3/1972 | MacDougall | 229/73 |
| 3,833,167 | 9/1974 | Kapitan | 229/305 |
| 3,863,835 | 2/1975 | Gendron | 229/69 |
| 4,487,360 | 12/1984 | Fisher et al. | 229/304 |
| 4,754,915 | 7/1988 | Steidinger | 229/92.7 |
| 4,830,269 | 5/1989 | Jenkins | 229/73 |
| 4,840,306 | 6/1989 | Lombardo | 229/304 |
| 4,889,278 | 12/1989 | Steidinger | 229/92.1 |
| 4,898,322 | 2/1990 | Coffey et al. | 229/69 |
| 4,915,287 | 4/1990 | Volk et al. | 229/70 |
| 4,927,072 | 5/1990 | Jenkins et al. | 229/92.3 |
| 5,174,494 | 12/1992 | Ashby | 229/305 |

*Primary Examiner*—Stephen P. Garbe
*Attorney, Agent, or Firm*—Nixon & Vanderhye

[57] ABSTRACT

A first sheet of large (e.g. 8½×11 inch) size and a second sheet connected by adhesive to the first sheet only at a reply envelope portion, form a mailer type business form. The first sheet is eccentrically Z-folded about fold lines to produce the mailer, with permanent adhesive sealing the panels of the mailer together, the return envelope being disposed within the mailer. Located next to the return envelope inside the mailer, separated by a perforation line, is a reply statement portion having reply statement indicia printed on it. The entire intermediate may be simplex printed because of its eccentric Z-shape configuration.

20 Claims, 5 Drawing Sheets

FIG. 5
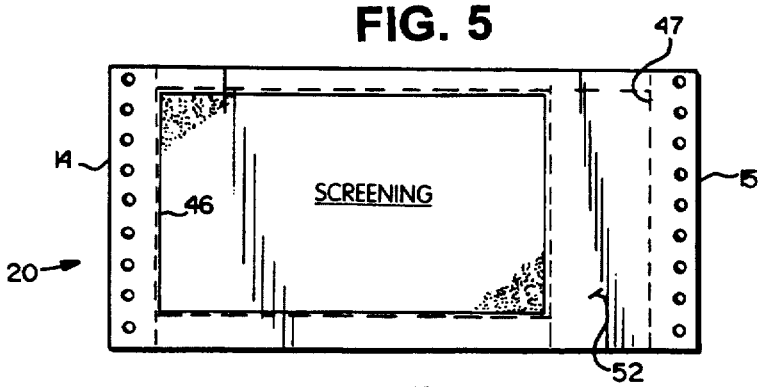
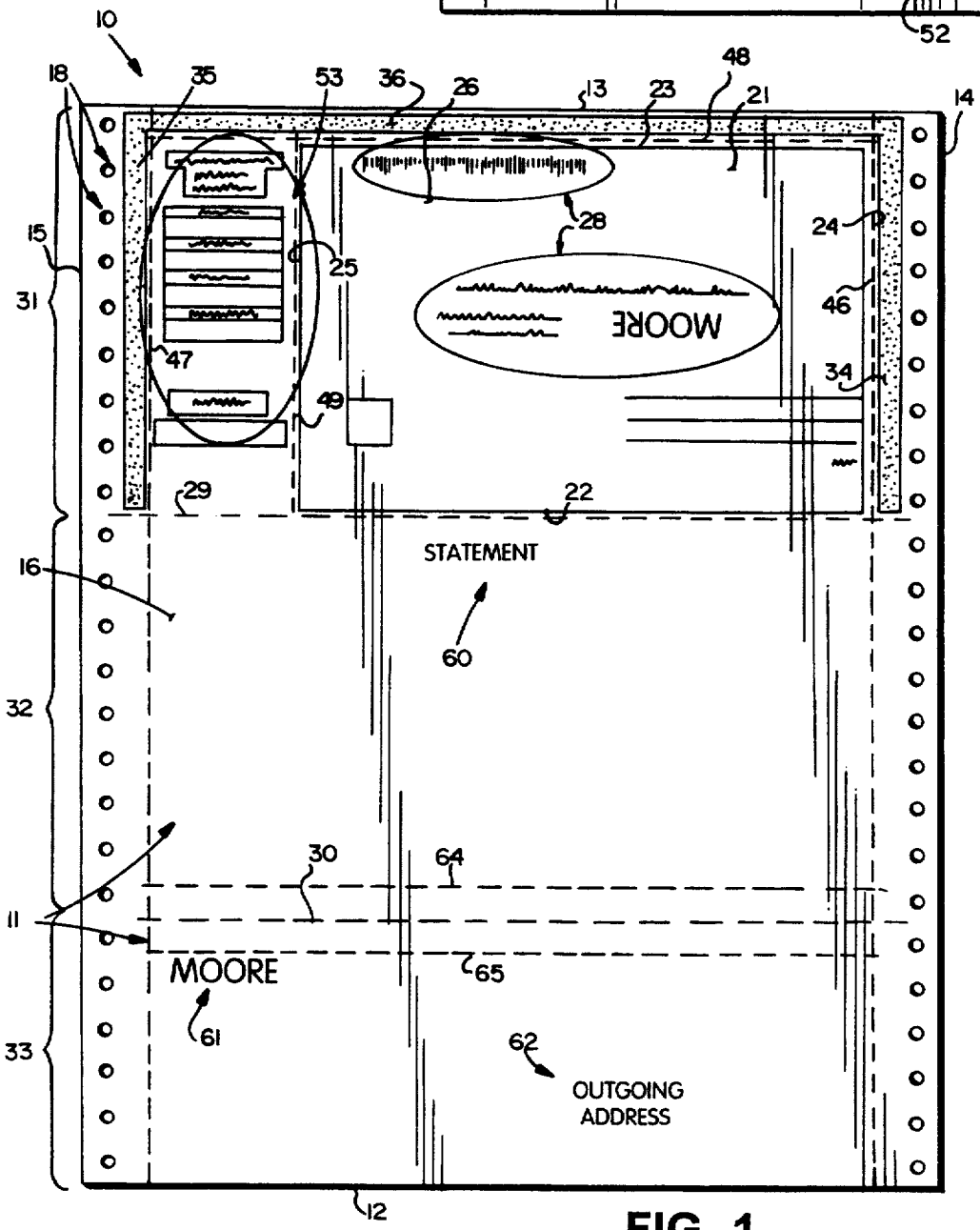
FIG. 1

ECCENTRIC Z-FOLD WITH BUILT-IN RETURN ENVELOPE

BACKGROUND AND SUMMARY OF THE INVENTION

A piece of paper, a first conventional size sheet (e.g. $8\frac{1}{2}\times11$), and a second much smaller sheet having dimensions only of the reply envelope, are used to make a mailer. The second sheet may be mated by glue to a first panel of the first sheet, and a reply statement portion may be provided adjacent to the reply envelope in the first panel, adapted to be detached and returned with a check in the reply envelope. A multi-part form according to the invention may be made in one pass on a "tight web" mailer machine, such as a SPEEDIFOLD 85 machine of Moore Business Forms, Inc. of Lake Forest, Ill. The form is constructed so that the first sheet may be simplex printed with all relevant data if desired.

The mailer according to the present invention has numerous advantages over Z-fold conventional mailers that have inserted return envelopes. By providing the built in return envelope according to the invention, a customer for the business forms of the invention need not maintain a separate supply of return envelopes, and does not have to worry about inserting an envelope on line, which insertion step often leads to jams or shutdowns of the processing equipment. The outgoing sealed mailer according to the invention is thinner than a comparable mailer with an inserted reply envelope would be due to the elimination of one ply of an inserted reply envelope. Also the outgoing mailer of the invention will seal better without an inserted envelope getting in the way of the permanent adhesive (e.g. heat seal) patterns that are provided. The mailer according to the invention provides no additional problems for processing than would be provided by a glassine patch on a window, or the like.

According to a first aspect of the present invention, a mailer type business form with a built in reply envelope is provided comprising the following elements: A first sheet forming at least first and second plies, the first and second plies separated by a first fold line and being of essentially identical size, each having a first length and first width; and each having inner and outer faces and side edges. First adhesive connecting the first and second plies together so that the inner faces thereof are face to face, including first adhesive patterns disposed adjacent the side edges. A second sheet having length and width dimensions substantially less than the first ply, and having first and second side edges and first and second end edges, and top and bottom faces. Second adhesive, comprising a pattern of non-activated adhesive, disposed on the bottom face of the second sheet adjacent the first end thereof. Third adhesive connecting the second sheet to the first ply inner face, comprising third adhesive patterns connecting the side edges and the second end edge of the second sheet to the inner face of the first ply. A first line of weakness formed in the first ply adjacent and parallel to the second side edge of the second sheet, between the second side edge of the second sheet and the closest side edge of said first ply to the second side edge of the second sheet. And, a second line of weakness formed in the first ply adjacent the second adhesive and parallel to the first fold line, facilitating detachment of a stub of the first ply to allow access to the second adhesive.

The first sheet typically further comprises a third ply connected to the second ply by a second fold line on the opposite side of the second ply from the first ply. The third ply has a length substantially the same as the first ply but a width substantially less than the first width, and has inner and outer faces. Return address indicia is imaged on the third ply adjacent the second fold line, and fourth adhesive is disposed between the third ply inner face and the second ply outer face for holding the second and third plies together, so that the first, second, and third plies have an eccentric Z-fold configuration. The fourth lines of weakness may also be disposed in the first through third plies of the first sheet adjacent the first and fourth adhesive patterns disposed adjacent the same side edges on the opposite sides thereof as the respective first and fourth adhesive patterns, for allowing opening of the mailer. The first, second, and fourth lines of weakness may define edges of a reply statement portion adapted to be detached along the first, second and fourth lines of weakness and inserted into the reply envelope, and reply statement indicia is printed on the inner face of the reply statement portion of the first ply. The first adhesive pattern preferably comprises a generally U-shaped pattern of permanent adhesive disposed on the inner face of the first ply, connecting the first and second plies together adjacent three edges thereof. The second adhesive preferably comprises rewettable adhesive. Indicia is imaged on the inner faces of the first and second plies, but the outer faces of the first and second plies may be substantially devoid of indicia.

The invention also contemplates an intermediate for a mailer type business form. The intermediate comprises the following elements: A first sheet having top and bottom edges, first and second side edges, and first and second faces. A first fold line extending parallel to the top and bottom edges and dividing the sheet into first and second panels, the first and second panels of substantially the same size, each having a first width and a first length. A first adhesive pattern disposed on the first face, parallel to the top edge for holding the first and second panels together when the sheet is folded about the first fold line to form a mailer. Second and third adhesive patterns disposed on the first face adjacent the first and second side edges, respectively, and parallel thereto. A generally U-shaped fourth adhesive pattern. A second sheet having a second length and width, each less than the first length and width, and having top, bottom, and first and second side edges. A pattern of activatable, but non-activated, adhesive disposed adjacent and parallel to the top edge of the second sheet, on the second face thereof on a flap portion. And, the second sheet second face connected by the fourth adhesive pattern at the bottom and side edges thereof to the first panel first face to define a return envelope, the flap portion defining a flap.

It is the primary object of the present invention to provide an advantageous mailer, with built in return envelope, that may be simplex printed, and an intermediate for construction thereof. This and other objects of the invention will become clear from an inspection of the detailed description of the invention and from the appended claims.

BRIEF DESCRIPTION OF THE DRAWINGS

FIG. 1 is a top plan view of a first face of an intermediate for a mailer type business form according to the present invention;

FIG. 5 is a rear view of the mailer formed according to FIG. 4;

DETAILED DESCRIPTION OF THE DRAWINGS

Figure 2:
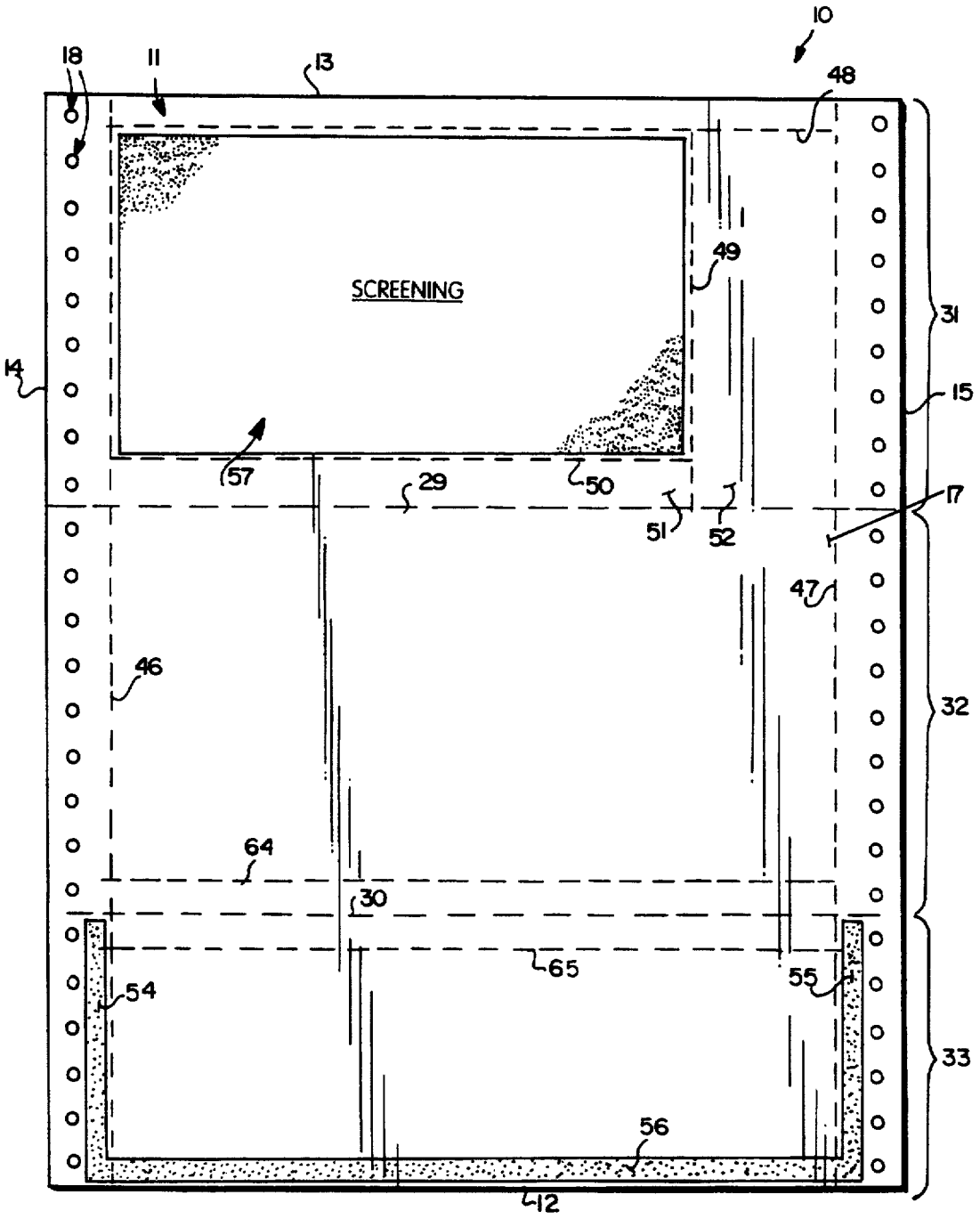
FIG. 2 is a bottom plan view of the intermediate of FIG. 1.
Figure 3:
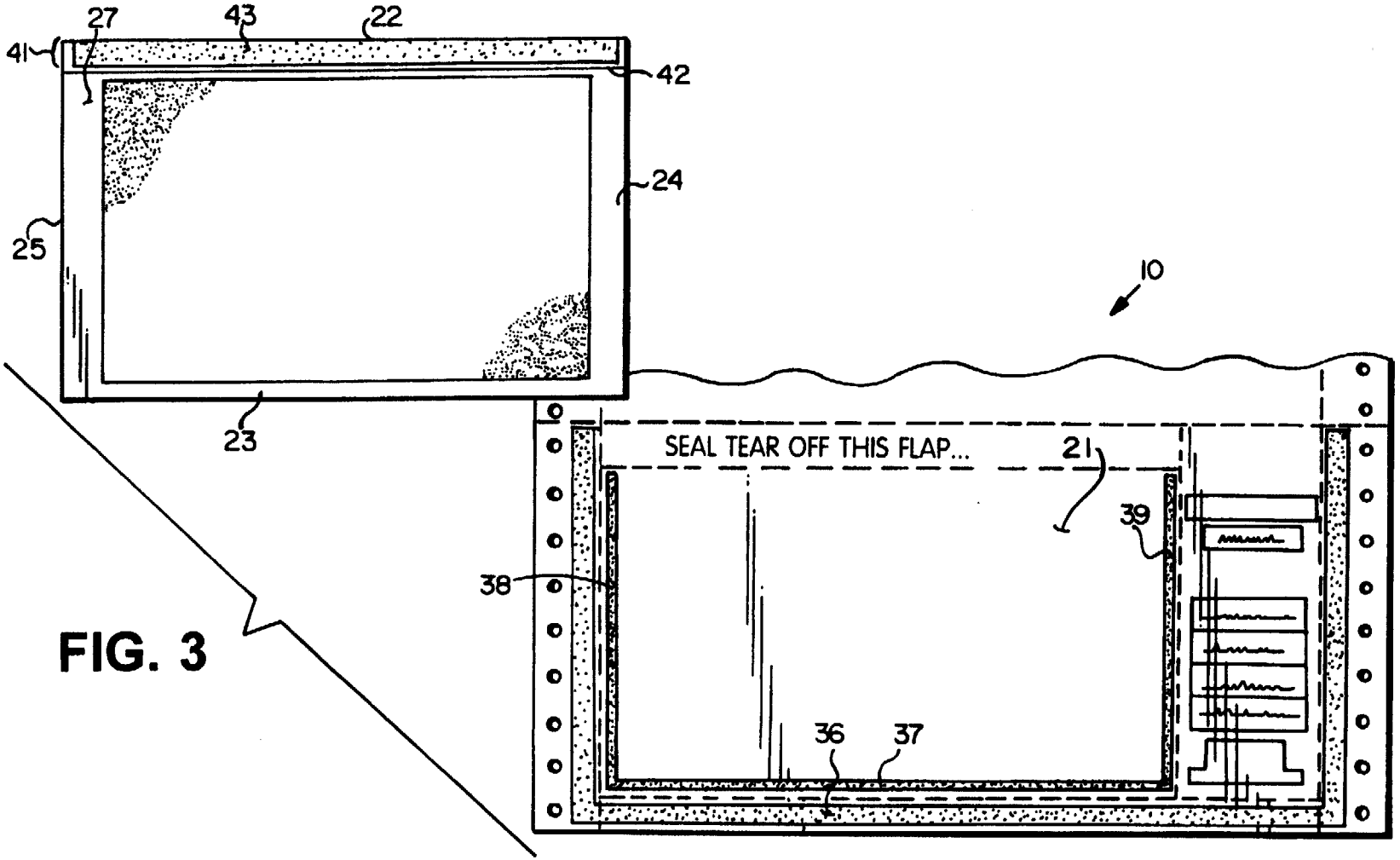
FIG. 3 is a partial view, part in plan and part in perspective, showing the first panel of the intermediate of FIG. 1 with the second sheet (which forms the reply envelope) removed therefrom.
Figure 4:
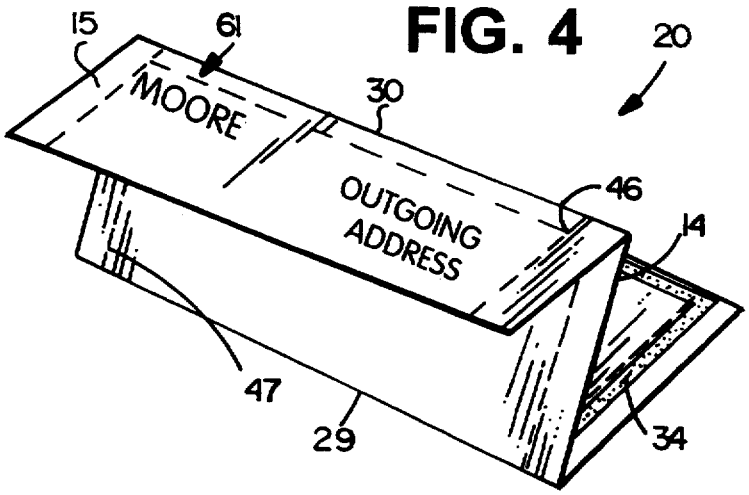
FIG. 4 is a top perspective view showing the folding of the intermediate of FIGS. 1 through 3 into an eccentric Z-folded mailer.

An intermediate for a mailer type business form according to the present invention is shown generally by reference numeral 10 in FIGS. 1 through 3. The intermediate comprises a first sheet 11 (the only sheet shown in FIG. 2) of paper or the like, having top 12 and bottom 13 edges, and first 14 and second 15 side edges, the edges 12, 13 being parallel to each other and the edges 14, 15 parallel to each other and transverse to the edges 12, 13. The intermediate 10 also has a first face 16 (the face shown in FIG. 1) and a second face 17 (the face shown in FIG. 2). While the sheet 11 is shown with tractor drive openings (e.g. 18) on the marginal portions thereof by the edges 15, 14, typically once a mailer (as seen in FIGS. 4 and 5) is constructed utilizing the intermediate 10, or just prior to mailer construction, the marginal portions containing the tractor drive openings 18 are slit off and are not provided in the final product/mailer 20 (see FIGS. 4 and 5).

The intermediate 10 also comprises a second sheet 21—seen in FIGS. 1 and 3—which has a length and width much less than the first length and first width of the sheet 11, and which also has top 22, bottom 23, and side 24, 25 edges. It has a top face (see in FIG. 1), indicated generally by reference numeral 26, and a bottom face (seen in FIG. 3) indicated generally by reference numeral 27. Note that reply address indicia, preferably both in human and machine readable form, 28 is provided on the top face 26, while preferably the bottom face 27 is screened (to make it basically opaque) over the majority of the dimensions thereof (see FIG. 3).

The sheet 11 preferably is divided into three panels 31–33 by first and second fold lines 29, 30 respectively, the first fold line 29 and the bottom edge 13 defining the first panel 31, while the second panel 32 is provided between the fold lines 29, 30, and third panel 33 is provided between the second fold line 30 and the top edge 12. Note that the panels 31, 32 are of essentially the same dimensions, while the third panel 33 has the same length as, but a substantially narrower width (the dimension between second fold line 30 and top edge 12) than, the panels 31, 32.

A first adhesive pattern is provided on the first face 16 of the sheet 11 for holding the panels 31, 32 together in face-to-face engagement when the intermediate 10 is folded about the first fold line 29. The first pattern preferably includes the permanent adhesive strips 34, 35 adjacent the side edges 14, 15 and parallel thereto, preferably disposed on the first panel 31, and the strip 36 also is preferably provided adjacent the edge 13 and parallel thereto, the strips 34–36 forming a generally U-shaped seal configuration. The adhesive forming the strips 34–36 may be heat seal adhesive, or other permanent machine-activated adhesive.

Another U-shaped adhesive pattern is preferably provided for holding the second sheet 21 onto the first panel 31 of the first sheet 11. This U-shaped pattern is seen in FIG. 3, and includes a portion 37 adjacent and parallel to the strip 36, and side portions 38, 39, the side portion 38 being adjacent and parallel to the strip 34, while the strip 39 is parallel to but spaced from the strip 35. The strips 37–39 permanently seal the second sheet 21 to the first sheet 11 at the first panel 31. A flap portion 41—which may be defined by a fold line 42 (see FIG. 3) is provided as part of the sheet 21 to serve as the seal flap for the reply envelope formed thereby, and has a pattern (e.g. strip) of activatable, but non-activated, adhesive 43 (see FIGS. 3 and 6) disposed on the face 27 at the flap 41, preferably rewettable adhesive.

Figure 6:
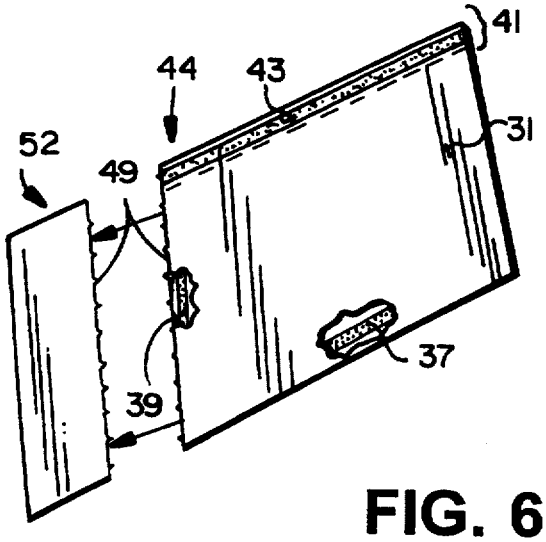
FIG. 6 is a rear view of the reply envelope of the mailer of FIGS. 4 and 5 once the mailer has been opened during detachment from the reply envelope.

The reply envelope constructed as described above is shown generally by reference numeral 44 in FIG. 6.

The intermediate 10 also comprises various lines of weakness for allowing ready detachment of a component forming a reply statement portion from the rest of the mailer. Preferably lines of weakness (e.g. perforations) 46, 47 are disposed parallel to the side edges 14, 15, respectively (see FIGS. 2 and 4) on the opposite sides of the adhesive strips 34, 35 (see FIG. 1) from the edges 14, 15. A similar line of weakness (perforation) 48 can be provided associated with the strip 36. Also the fold lines 29, 30 preferably are lines of weakness (e.g. perforations).

Perforations or other lines of weakness are also provided in the first panel 31. Note the perforation line 49 extending parallel to the side edges 14, 15 and close to, but spaced from, the side edge 15, and adjacent the reply envelope 44 side edge 25. Note also the perforation line 50 extending between the lines 46, 49 and adjacent the first fold line 29, and having a width substantially the same as the width of the flap 41 of the return envelope 44. The lines 46, 49, 50, 29 allow detachment of the stub portion 51 to expose the rewettable adhesive 43 of the flap 41, as seen in FIG. 6. The lines 29, 47 48, and 49 also allow detachment of the reply statement portion 52 (see FIGS. 2 and 4) having reply statement indicia 53 (see FIG. 1) thereon, which when separated from the reply envelope 44 can be inserted within it and returned to the reply addressee (indicated by indicia 28) with a check in the reply envelope 44.

The intermediate 10 also preferably comprises the U-shaped permanent adhesive pattern illustrated in FIG. 2, formed by strips 54, 55, and 56, which are provided on the second face of the third panel 33, and when activated (e.g. during heat sealing of the intermediate 10 to form the mailer 20) holds the second face of the third panel 33 to the second face of the second panel 32. A screening area, shown generally by reference numeral 57 in FIG. 2, may also be provided on the second face of the first panel 31 where the reply envelope 44 is provided.

The intermediate 10 may also have additional indicia thereon, such as the statement indicia 60 on the first (inner) face of the second panel 32, the outgoing mailer return address indicia 61 provided on the first face 16 of the third panel 33, outgoing address indicia 62 provided on the third panel 33 (or if necessary provided on second face 17 of the second panel 32), etc.

Additional lines of weakness 64, 65 may also be provided straddling the second fold line 30 in the second panel 32 and third panel 33, respectively, which align with the perforation line 48 in the final mailer 20, to facilitate opening of the mailer 20.

In order to make the mailer 20 from the intermediate 10, one merely eccentrically Z-folds the intermediate 10 about lines 29, 30, as illustrated in FIG. 4, and then passes the mailer 20 through a heat sealer or the like for sealing the adhesive strips 34 through 36 and 54 through 56 to form the mailer 20 as illustrated in FIG. 5. The first panel 31 then becomes a first ply of the mailer 20 with the first face 16 thereof an inner face of the mailer, while the second panel 32 provides the second ply, and the third panel 33—if provided—comprises the third ply. Note that because of the eccentric Z-fold configuration, all of the indicia 28, 53, and 60 through 62 may be simplex printed (that is just on the face 16).

Once the mailer 20 is opened by tearing along the perforation lines 46 through 48, 64, 65, 29, 30, and 50, the return envelope 44 with attached reply statement portion 52 are provided, as seen in FIG. 6. By tearing along perforation 49, the reply envelope 44 and reply statement portion 52 may then also be detached from each other as schematically illustrated in FIG. 6.

Figure 7:
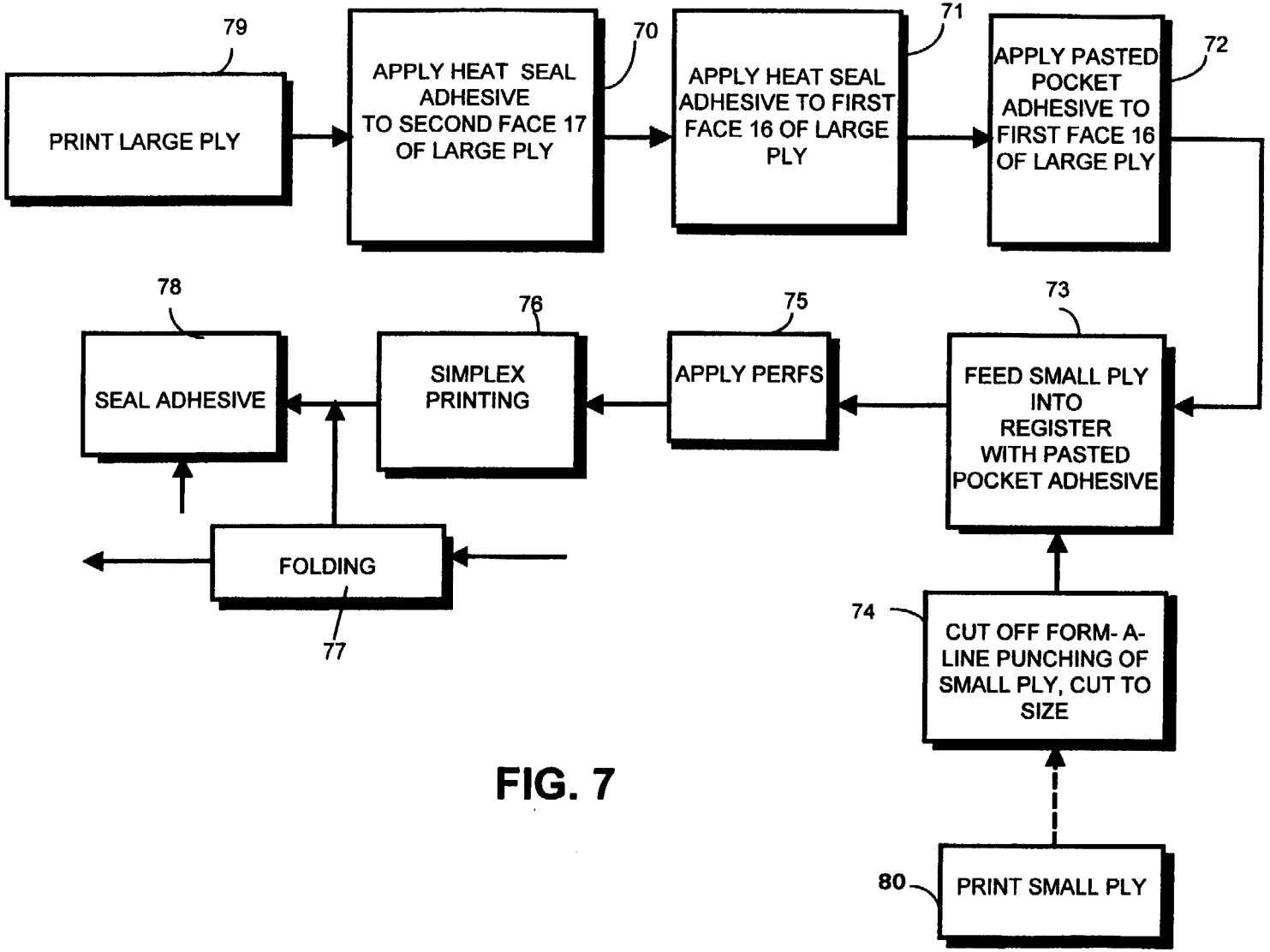
FIG. 7 is one exemplary schematic showing an exemplary manner of constructing the mailer of FIGS. 4 and 5.

While there are a wide variety of methods for making the mailer 20 according to the invention, one exemplary method is illustrated schematically in FIG. 7. As illustrated in FIG. 7, the second face 17 of the first sheet 11 has heat seal adhesive applied as indicated at box 70 by passing it through a tight web machine (SPEEDI-FOLD 85). It then proceeds through the machine to a set of turn-over bars which flip the sheet 11 over and expose the face 16 where a hot melt heat seal adhesive (e.g. 34–36) is applied to the first face 16, as illustrated at box 71. Then sheet 11 goes through a first cold glue patch unit where a pasted pocket adhesive (the strips 37 through 39) are applied as indicated at box 72 in FIG. 7.

Simultaneously with the practice of steps 70–72, the second sheet 21 is being formed. A web for forming the second sheet 21 is mounted on the patch unit on one spindle and is cut off every four inches or so (depending upon the dimension of the return envelope 44 to be constructed) and placed in register over the adhesive strips 37 through 39, as indicated at stage 73 in FIG. 7. Prior to being placed in such registry, however, the form-a-liner punching required to maintain registry is slit off—as indicated at box 74 in FIG. 7. The rewettable glue strip 43 may be applied at press.

Perf lines (e.g. 47 through 49, etc. ) may then be applied, either in the cold glue patch unit, or in a second perf unit (typically for inserting the fold lines 29, 30) as indicated by box 75. Then simplex printing on face 16 of all indicia 28, 53, 60–62, etc., can be provided, as indicated at stage 76, and then the sheet 11 can be eccentrically Z-folded at 77, and then passed to a conventional adhesive sealing station 78 where the adhesive is sealed by application of heat and/or pressure (depending upon the type of adhesive utilized for strips 34–36, etc.).

As an alternative to, or in addition to, the above method, non-variable information may be printed on both of the sheets 11, 21 prior to other activities, as indicated by dotted line boxes 79, 80 respectively in FIG. 7. In this case variable information would still be simplex printed as indicated at 76 (that is the outgoing address 62, the indicia 53 and 60, etc.).

It will thus be seen that according to the present invention an advantageous mailer with a built in reply envelope has been provided. While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A mailer type business form with a built-in reply envelope, comprising:

a first sheet forming at least first and second plies, the first and second plies separated by a first fold line and being of essentially identical size, each having a first length and first width; and each having inner and outer faces and side edgest and said first ply has a bottom edge;

first adhesive connecting said first and second plies together so that said inner faces thereof are face to face, including first adhesive patterns disposed adjacent said side edges;

a second sheet having length and width dimensions substantially less than said first ply, and having first and second side edges and first and second end edges, and top and bottom faces;

second adhesive, comprising a pattern of non-activated adhesive, disposed on said bottom face of said second sheet adjacent said first end thereof;

third adhesive connecting said second sheet to said first ply inner face, comprising third adhesive patterns connecting said side edges and said second end edge of said second sheet to said inner face of said first ply;

a first line of weakness formed in said first ply adjacent and parallel to said second side edge of said second sheet, between said second side edge of said second sheet and the closest side edge of said first ply to said second side edge of said second sheet;

a second line of weakness formed in said first ply adjacent said second adhesive and parallel to said first fold line, facilitating detachment of a stub of said first ply to allow access to said second adhesive; and a fourth adhesive pattern disposed adjacent and parallel to said bottom edge of said first sheet on said first ply inner face, and a third line of weakness disposed adjacent and parallel to said fourth adhesive pattern on the opposite side thereof from said bottom edge.

2. A mailer as recited in claim 1 further comprising indicia imaged on said inner faces of said first and second plies.

3. A mailer as recited in claim 2 wherein said first sheet further comprises a third ply connected to said second ply by a second fold line on the opposite side of said second ply from said first ply, said third ply having a length substantially the same as said first length, but having a width substantially less than said first width, and having an inner and an outer face; return address indicia imaged on said third ply adjacent said second fold line; and fourth adhesive disposed between said third ply inner face and said second ply outer face for holding said second and third plies together so that said first, second, and third plies have an eccentric Z-fold configuration.

4. A mailer as recited in claim 1 wherein said first adhesive comprises a generally U-shaped pattern of permanent adhesive disposed on said inner face of said first ply, connecting said first and second plies together adjacent three edges thereof.

5. A mailer as recited in claim 1 wherein said second adhesive comprises rewettable adhesive.

6. An intermediate for a mailer type business form comprising:

a first sheet having top and bottom edges, first and second side edges, and first and second faces;

a first fold line extending parallel to said top and bottom edges and dividing said sheet into first and second panels, said first and second panels of substantially the same size, each having a first width and a first length, a first adhesive pattern disposed on said first face, parallel to said top edge for holding said first and second panels together when said sheet is folded about said first fold line to form a mailer;

second and third adhesive patterns disposed on said first face adjacent said first and second side edges, respectively, and parallel thereto;

a generally U-shaped fourth adhesive pattern;

a second sheet having a second length and width, each less than said first length and width, and having top, bottom, and first and second side edges;

a pattern of activatable, but non-activated, adhesive disposed adjacent and parallel to said top edge of said second sheet, on said second face thereof on a flap portion;

said second sheet second face connected by said fourth adhesive pattern at said bottom and side edges thereof to said first panel first face to define a return envelope, said flap portion defining a flap; and a second fold line extending parallel to said top and bottom edges further dividing said sheet into a third panel, on the opposite side of said second panel from said first panel, said third panel having first and second faces providing continuations of said first and second faces of said first and second panels, and having said first length but a second width, substantially less than said first width; and a fifth adhesive pattern disposed on said second face of either said second or third panels for holding said panels together when said sheet is folded about said second fold line.

7. An intermediate as recited in claim 6 further comprising indicia imaged on said first face of each of said first, second, and third panels, said second faces of said panels being substantially devoid of indicia.

8. An intermediate as recited in claim 7 wherein said fourth adhesive pattern is provided on said first face of said first panel.

9. An intermediate as recited in claim 7 wherein indicia imaged on said first face of said first panel adjacent said second sheet comprises reply statement indicia; and further comprising reply address indicia imaged on said second sheet, for providing a reply address for said reply envelope.

10. An intermediate as recited in claim 9 further comprising a first line of weakness formed in said first panel adjacent and parallel to said second side edge of said second sheet, between said second side edge of said second sheet and the closest side edge of said first ply to said second side edge of said second sheet; and a second line of weakness formed in said first panel adjacent said second adhesive and parallel to said first fold line, facilitating detachment of a stub of said first panel to allow access to said pattern of activatable but non-activated adhesive disposed on said flap portion; said first line of weakness defining an edge of a reply statement portion, having said reply statement indicia thereon.

11. An intermediate as recited in claim 10 further comprising third and fourth lines of weakness extending parallel to said first and second side edges and disposed adjacent said second and third adhesive patterns respectively, on the opposite sides thereof from said first and second side edges, respectively.

12. An intermediate as recited in claim 6 further comprising first and second lines of weakness extending parallel to said first and second side edges and disposed adjacent said second and third adhesive patterns respectively, on the opposite sides thereof from said first and second side edges, respectively.

13. An intermediate for a mailer type business form comprising:

a first sheet having top and bottom edges, first and second side edges, and first and second faces;

a first fold line extending parallel to said top and bottom edges and dividing said sheet into first and second panels, said first and second panels of substantially the same size, each having a first width and a first length, a first adhesive pattern disposed on said first face, parallel to said top edge for holding said first and second panels together when said sheet is folded about said first fold line to form a mailer;

second and third adhesive patterns disposed on said first face adjacent said first and second side edges, respectively, and parallel thereto;

a generally U-shaped fourth adhesive pattern;

a second sheet having a second length and width, each less than said first length and width, and having top, bottom, and first and second side edges;

a pattern of activatable, but non-activated, adhesive disposed adjacent and parallel to said top edge of said second sheet, on said second face thereof on a flap portion;

said second sheet second face connected by said fourth adhesive pattern at said bottom and side edges thereof to said first panel first face to define a return envelope, said flap portion defining a flap;

first and second lines of weakness extending parallel to said first and second side edges and disposed adjacent said second and third adhesive patterns respectively, on the opposite sides thereof from said first and second side edges, respectively; and a fifth adhesive pattern disposed adjacent and parallel to said bottom edge of said first sheet on said first panel first face, and a third line of weakness disposed adjacent and parallel to said fifth adhesive pattern on the opposite side thereof from said bottom edge.

14. An intermediate as recited in claim 13 further comprising a second fold line extending parallel to said top and bottom edges further dividing said sheet into a third panel, on the opposite side of said second panel from said first panel, said third panel having first and second faces providing continuations of said first and second faces of said first and second panels, and having said first length but a second width, substantially less than said first width; and a fifth adhesive pattern disposed on said second face of either said second or third panels for holding said panels together when said sheet is folded about said second fold line.

15. A mailer type business form with a built-in reply envelope, comprising:

a first sheet forming at least first and second plies, the first and second plies separated by a first fold line and being of essentially identical size, each having a first length and first width; and each having inner and outer faces and side edges;

first adhesive connecting said first and second plies together so that said inner faces thereof are face to face, including first adhesive patterns disposed adjacent said side edges;

a second sheet having length and width dimensions substantially less than said first ply, and having first and second side edges and first and second end edges, and top and bottom faces;

second adhesive, comprising a pattern of non-activated adhesive, disposed on said bottom face of said second sheet adjacent said first end thereof;

third adhesive connecting said second sheet to said first ply inner face, comprising third adhesive patterns connecting said side edges and said second end edge of said second sheet to said inner face of said first ply;

a first line of weakness formed in said first ply adjacent and parallel to said second side edge of said second sheet, between said second side edge of said second sheet and the closest side edge of said first ply to said second side edge of said second sheet;

a second line of weakness formed in said first ply adjacent said second adhesive and parallel to said first fold line, facilitating detachment of a stub of said first ply to allow access to said second adhesive; and wherein said first adhesive comprises a generally U-shaped pattern of permanent adhesive disposed on said inner face of said first ply, connecting said first and second plies together adjacent three edges thereof.

16. A mailer type business form with a built-in reply envelope, comprising:

a first sheet forming at least first and second plies, the first and second plies separated by a first fold line and being of essentially identical size, each having a first length and first width; and each having inner and outer faces and side edges;

first adhesive connecting said first and second plies together so that said inner faces thereof are face to face, including first adhesive patterns disposed adjacent said side edges;

a second sheet having length and width dimensions substantially less than said first ply, and having first and second side edges and first and second end edges, and top and bottom faces;

second adhesive, comprising a pattern of non-activated adhesive, disposed on said bottom face of said second sheet adjacent said first end thereof;

third adhesive connecting said second sheet to said first ply inner face, comprising third adhesive patterns connecting said side edges and said second end edge of said second sheet to said inner face of said first ply;

a first line of weakness formed in said first ply adjacent and parallel to said second side edge of said second sheet, between said second side edge of said second sheet and the closest side edge of said first ply to said second side edge of said second sheet;

a second line of weakness formed in said first ply adjacent said second adhesive and parallel to said first fold line, facilitating detachment of a stub of said first ply to allow access to said second adhesive;

wherein said first sheet further comprises a third ply connected to said second ply by a second fold line on the opposite side of said second ply from said first ply, said third ply having a length substantially the same as said first length, but having a width substantially less than said first width, and having an inner and an outer face;

return address indicia imaged on said third ply adjacent said second fold line; and fourth adhesive disposed between said third ply and said second ply for holding said second and third plies together so that said first, second, and third plies have an eccentric Z-fold configuration.

17. A mailer as recited in claim 16 wherein said outer faces of said first and second plies are substantially devoid of indicia.

18. A mailer as recited in claim 16 further comprising third and fourth lines of weakness disposed in said first through third plies of said first sheet adjacent said first and fourth adhesive patterns disposed adjacent said side edges on the opposite sides thereof as said respective first and fourth adhesive patterns, for allowing opening of said mailer.

19. A mailer as recited in claim 16 wherein said first, second, and fourth lines of weakness define edges of a reply statement portion adapted to be detached along said first, second and fourth lines of weakness and inserted into said reply envelope; and further comprising reply statement indicia printed on said inner face of said reply statement portion of said first ply.

20. A mailer type business form with a built-in reply envelope, comprising:

a first sheet forming at least first and second plies, the first and second plies separated by a first fold line and being of essentially identical size, each having a first length and first width; and each having inner and outer faces and side edges;

first adhesive connecting said first and second plies together so that said inner faces thereof are face to face, including first adhesive patterns disposed adjacent said side edges;

a second sheet having length and width dimensions substantially less than said first ply, and having first and second side edges and first and second end edges, and top and bottom faces;

second adhesive, comprising a pattern of non-activated adhesive, disposed on said bottom face of said second sheet adjacent said first end thereof;

third adhesive connecting said second sheet to said first ply inner face, comprising third adhesive patterns connecting said side edges and said second end edge of said second sheet to said inner face of said first ply;

a first line of weakness formed in said first ply adjacent and parallel to said second side edge of said second sheet, between said second side edge of said second sheet and the closest side edge of said first ply to said second side edge of said second sheet;

a second line of weakness formed in said first ply adjacent said second adhesive and parallel to said first fold line, facilitating detachment of a stub of said first ply to allow access to said second adhesive; wherein said first sheet further comprises a third ply connected to said second ply by a second fold line on the opposite side of said second ply from said first ply, said third ply having a length substantially the same as said first length, but having a width substantially less than said first width, and having an inner and an outer face;

return address indicia imaged on said third ply adjacent said second fold line; and fourth adhesive disposed between said third ply and said second ply for holding said second and third plies together so that said first, second, and third plies have an eccentric Z-fold configuration.

* * * * *